United States Patent [19]

Hayward et al.

[11] 3,978,613

[45] Sept. 7, 1976

[54] TURNSTILE MECHANISM

[75] Inventors: Martin Henry Hayward, Berkhamsted; Michael Charles Newton, Stevenage, both of England

[73] Assignee: Automatic Revenue Controls (Europa) Ltd., Watford, England

[22] Filed: Apr. 25, 1975

[21] Appl. No.: 571,772

[30] Foreign Application Priority Data

Apr. 29, 1974 United Kingdom ..... 18811/74

[52] U.S. Cl. ..... 49/46; 49/47

[51] Int. Cl.[2] ..... E06B 11/08

[58] Field of Search ..... 49/46, 47

[56] References Cited

UNITED STATES PATENTS

| | | | |
|---|---|---|---|
| 3,559,341 | 2/1971 | Alvarado | 49/47 |
| 3,795,075 | 3/1974 | Orzechowski | 49/46 |

FOREIGN PATENTS OR APPLICATIONS

| | | | |
|---|---|---|---|
| 1,264,468 | 2/1972 | United Kingdom | 49/46 |

*Primary Examiner*—Kenneth Downey
*Attorney, Agent, or Firm*—Wood, Herron & Evans

[57] ABSTRACT

A turnstile mechanism comprising a rotatable hub adapted to be driven by a person using a turnstile, the hub being connected to (or incorporating) a disc formed with a number of stop surfaces which are engageable by a stop member which is movable between a first position clear of the path of the stop surfaces and a second position lying in the path of the stop surfaces, the stop member being connected to control means which are operable to hold the stop member against a bias in either the first or second position, the control means being activated to change the position of the stop member from the first position to the second position when the hub has been rotated through a predetermined angle.

11 Claims, 4 Drawing Figures

TURNSTILE MECHANISM

Figure 1:
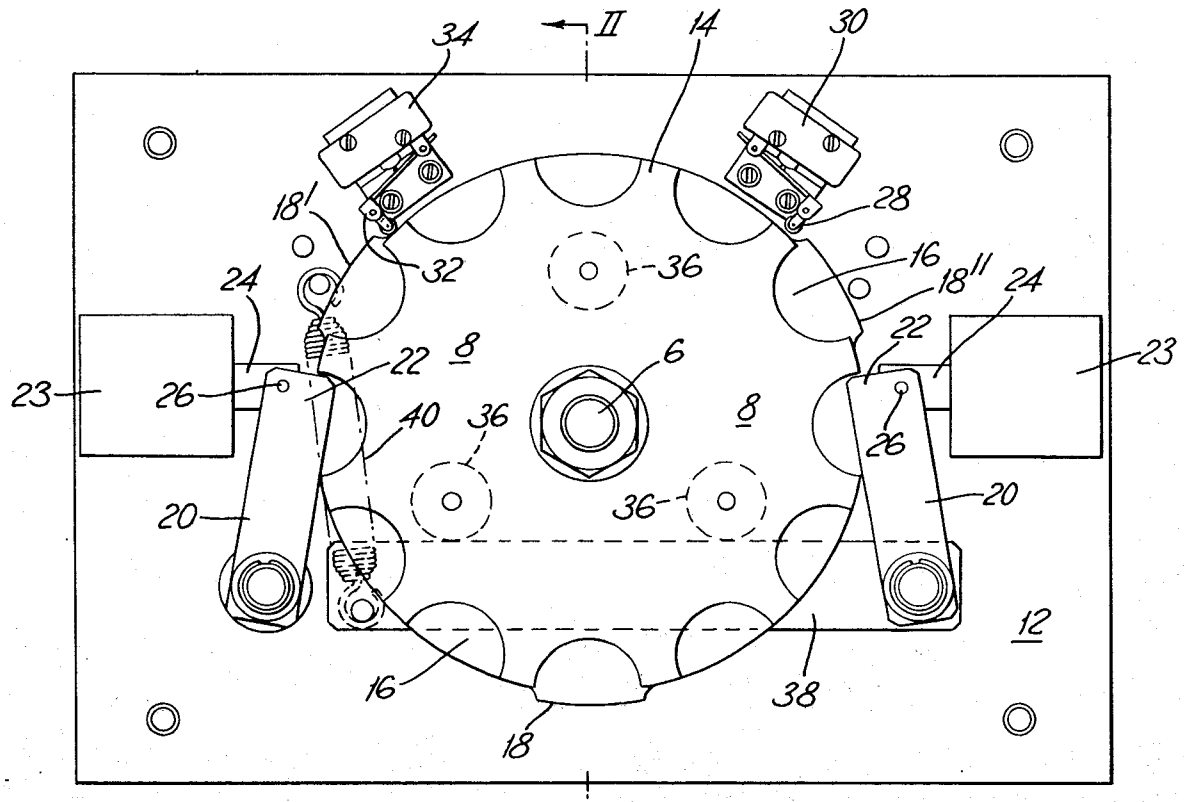

This invention relates to turnstile mechanisms.

A turnstile mechanism in accordance with the invention comprises a rotatable hub adapted to be driven by a person passing through the turnstile, the hub being connected to (or incorporating) a disc formed with stop surfaces which are engageable by a stop member which is movable between a first position clear of the path of the stop surfaces, and a second position engaging a stop surface, the stop member being connected to control means which are operable (for example in insertion of a coin into the mechanism) to hold the member in the first position, or allow the member to move to the first position, until the hub has been rotated to a predetermined angle whereupon the control means either releases the control member to allow it to move to the second position or acts to hold the control member in the second position.

Thus on insertion of a coin or other activation of the mechanism (e.g. by an attendant) the stop member may be moved to the first position allowing the hub to rotate to allow a person to pass through the turnstile. When the hub has moved sufficiently to allow one person only through, then the control means acts to release the stop member which engages the disc to prevent further rotation of the hub.

The stop member control means may be activated (after rotation of the hub through the predetermined angle) by a cam surface on a disc driven by the hub, the disc being either that formed with the stop surfaces or a second disc. In one convenient arrangement the stop member control means may comprise a mircro-switch arranged to be moved by a cam surface to an activated position in which it operates to cut-off energisation of a solenoid holding the stop member in the first position, the stop member being biased to move to the second position. Alternatively the solenoid may hold the stop member in the second position (the member in that case being biased to the first position), the microswitch then acting to energise the solenoid to move the stop member to the second position.

The stop member is preferably a pivoted arm and the stop surfaces formed on ratchet teeth, the arrangement being such that when the arm is in the second or stop position it co-operates with the teeth to act as a pawl and ratchet in one direction of rotation of the teeth and to abut a tooth to prevent rotation of the hub in the other direction of rotation.

If only one movable stop member is provided then the arrangement may be that the hub is always free to rotate in one direction (namely that in which the stop member acts as a ratchet when in the second position) rotation of the hub in the other direction being controlled by movement of the stop member. Alternatively a pawl arrangement (which may constitute a pivoted arm), may be provided to prevent rotation of the hub in the said first direction, rotation in the second direction being controlled by movement of the stop member.

As a further alternative two stop members may be provided each having a control means and the two members being positioned on opposite sides of the disc. In such an arrangement if both stop members are in the second position then the hub cannot turn in either direction. If one stop member is held in the first position (or allowed to move to the first position) then the hub and disc can rotate in one direction (namely that in which the second member is acting as a ratchet). If, however, the said stop member remains in the second or stop position and the said other stop member is moved to the first position, then the hub can rotate in the other direction (the said stop member acting as a ratchet) until the said other stop member is moved back to the second or stop position.

It will thus be seen that a turnstile mechanism in accordance with the invention is very versatile as well as being relatively simple in operation.

The teeth engaging end of one (or both) stop members is preferably provided with a roller. This has the advantage that the solenoid only has to move a roller out from engagement with a tooth so that if someone is pressing to pass through the turnstile and thus exerting a force between a disc tooth and the stop arm, friction will not prevent the solenoid moving the arm outwardly as it might were no roller to be present.

A homing device is preferably provided to ensure that the turnstile moves through the correct predetermined angle for passage of each person. This may be done by providing three equally spaced rollers around the disc (for the case in which a 120° rotation of the hub is required for each person) a pair of rollers being engaged by a spring loaded arm in the correct or home position of the hub. On rotation of the hub the arm is moved against the bias by one of the rollers until the roller has reached its outermost position whereupon the bias of the arm will help to turn the disc until the next correct rest or home position is reached. Alternatively the hub or disc may carry an approximately triangular shaped cam disc each of the sides of the disc being formed with a valley portion (between adjacent cam lobes) to receive a roller at the end of a biased homing arm.

Means may also be provided to damp down the second portion of any movement of the hub or disc i.e. that portion of movement when it is being biased to turn by the homing arrangement.

Figure 2:
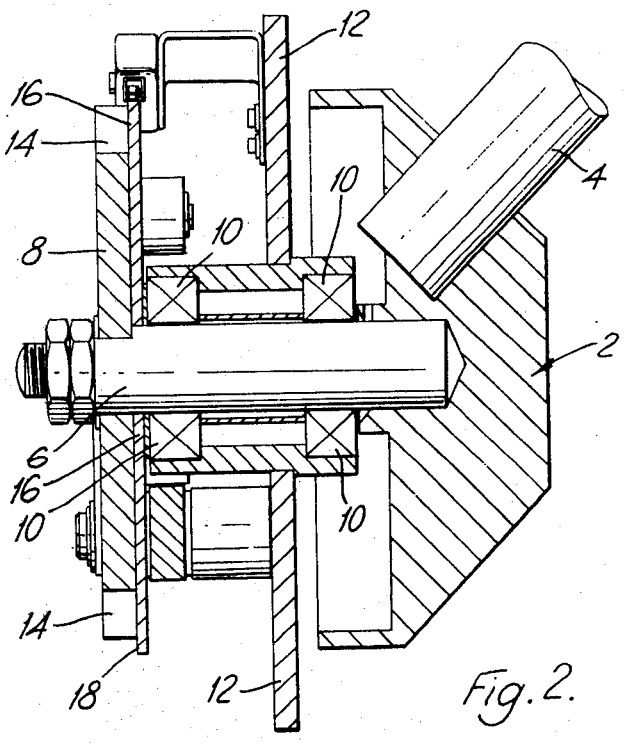
Figure 3:
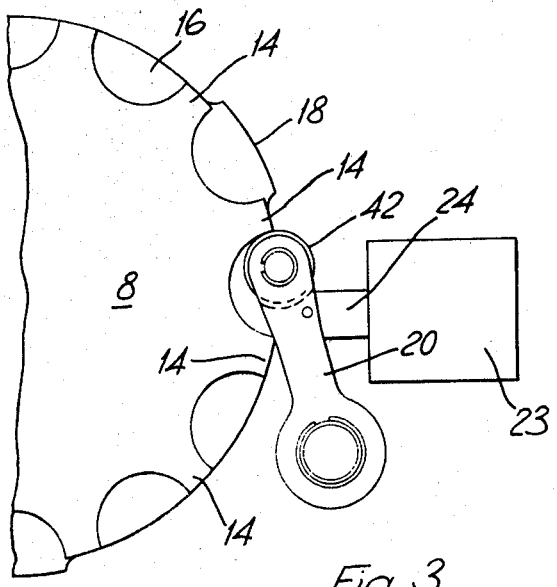
Figure 4:
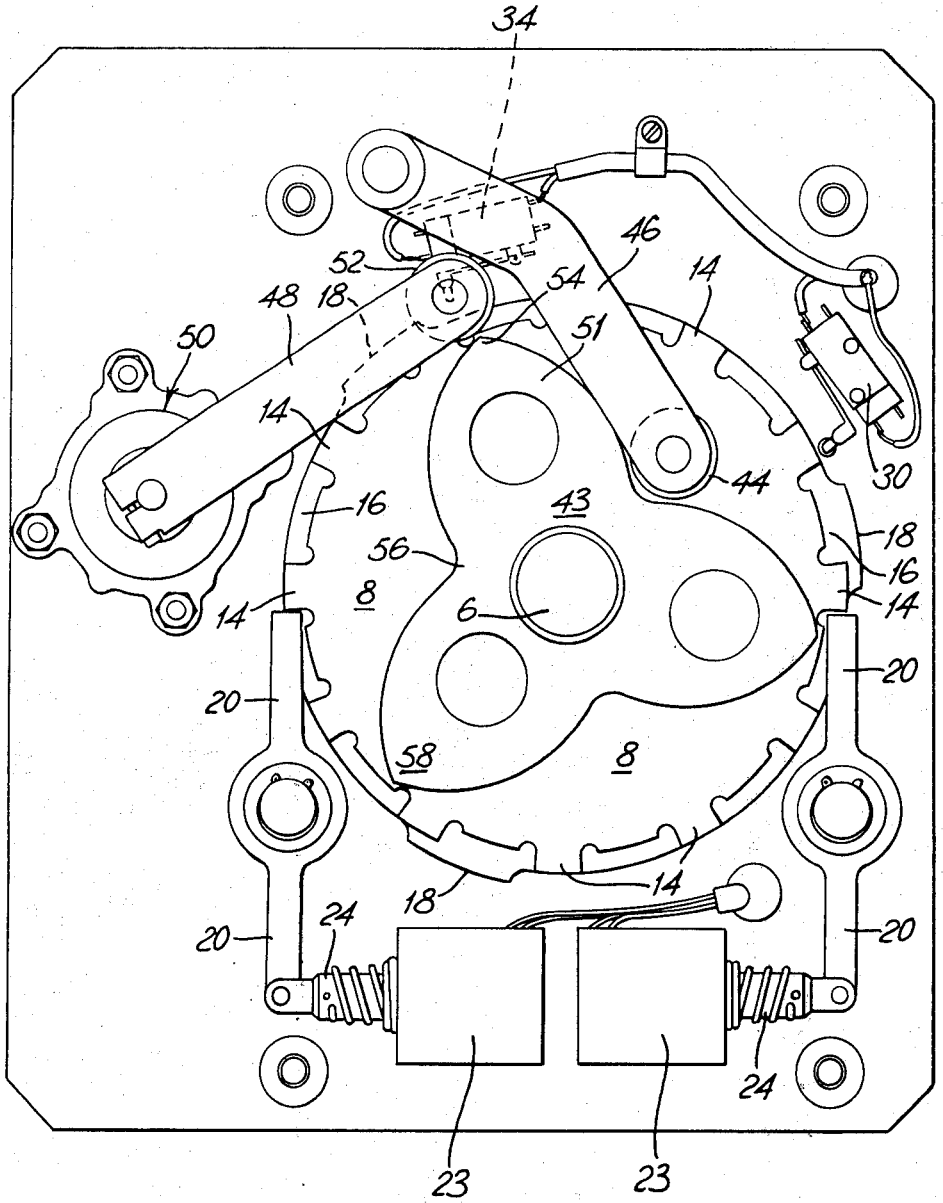

The invention will now be further described by way of example with reference to the accompanying drawings in which:

FIG. 1 is an underneath plan view showing one embodiment of turnstile mechanism in accordance with the invention, FIG. 2 is a section on the line II-II of FIG. 1, FIG. 3 is a diagram of a portion of the mechanism of FIG. 1 illustrating an alternative form of stop member, and FIG. 4 is a view similar to FIG. 1 but showing an alternative arrangement of the homing device.

Referring to FIGS. 1 and 2, the turnstile mechanism comprises a hub generally indicated at 2 having three outwardly extending arms 4 for engagement by a person wishing to pass through a passage controlled by a turnstile.

The hub 2 is carried on a main shaft 6 and carries a toothed disc 8, the shaft itself being mounted in bearings 10 in a back plate generally indicated at 12.

The disc 8 which is formed around its periphery with a number of teeth 14 lies adjacent a further disc 16 which is also connected to the main shaft 6 and which has three cam lobes 18 formed around its periphery.

Two stop members are provided each in the form of a pivoted arm 20 one on each side of the discs 8 and 16, each stop arm being movable between a "first position" in which its unpivoted or stop end 22 is clear of the periphery of the disc 8 and a second position as shown in the drawing in which the end 22 overlaps the periphery of the disc so as to engage (in each direction of rotation, respectively) the side or stop surface of a tooth 14.

The arms are movable between the first and second positions by means of solenoids 23, the operating arms 24 of which are pivotally connected at 26 to the stop arms.

In operation of the mechanism the solenoid 23 is operated for example by introduction of a coin into a coin acceptance unit or manually by an operator, and one of the stop arms 20 is moved by its solenoid to its first position clear of the disc 8. For example, if it is desired to rotate the hub in the clockwise direction shown in FIG. 1, then the right hand stop arm 20 is moved clear of the periphery of the disc. The left hand arm 20 remains in the position shown in FIG. 1 and is free to move out from the periphery of the disc against a bias which tends to urge it towards the periphery of the disc 8.

A person entering the passage controlled by the turnstile then moves the hub 2 in the clockwise direction by means of the arms 4 and the left hand stop arm 20 then acts as a ratchet riding over the teeth 14 and acting to prevent the disc from being counter-rotated in the anticlockwise direction.

When the hub and discs 8 and 14 have moved through an angle of 120° the cam lobe 18' as shown in FIG. 1, engages the operating arm 28 of a uni-direction micro-switch generally indicated at 30, movement of this arm 28 acting to de-energise the right hand solenoid 23 allowing the right hand stop arm 20 to move back towards the periphery of the disc 8 under control of its bias and so as to engage the stop surface or side of a tooth 14 to prevent further clockwise movement.

If it is desired to operate the turnstile mechanism in the anti-clockwise direction as shown in FIG. 1, then the left hand solenoid 23 is operated to move the left hand stop arm 20 to its position clear of the periphery of the disc 8. The right hand arm 20 then operates as a ratchet arm riding over the teeth 14. This anti-clockwise movement continues for 120° until the cam lobe 18'' engages the operating arm 32 of a further micro-switch generally indicated at 34 which acts to de-energise the left hand solenoid 23 and allow the left hand stop arm 20 to move back to its stop or second position as shown in FIG. 1 to prevent further movement of the hub.

It will be appreciated that instead of two stop arms 20 each acting to control movement in one direction of the rotation of the hub respectively only one may be provided. If only the right hand arm is provided then the hub and disc 8 are free to rotate at all times in an anti-clockwise direction, clockwise rotation being controlled by operation of the right hand solenoid 23 by the micro-switch 30. Alternatively if a single stop arm is provided, say the right hand arm as shown in FIG. 1, then a pawl device can be provided to replace the left hand stop arm 20 (the pawl device may have a form similar to that of an arm 20 but be spring biased towards the periphery of the disc and not be operated by a solenoid). In this case the hub is prevented from anti-clockwise rotation by the pawl, clockwise rotation being controlled by the position of the arm 20.

In all cases it is desirable to provide a homing device to urge the hub to "snap" home when it has rotated through the desired angle to admit one person i.e. 120° in the arrangement illustrated in the drawings.

As shown this homing device comprises three rollers 36 pivotally mounted to one side of the cam disc 16, the axis of each roller being spaced to the axis from the adjacent roller by 120° respectively.

A homing arm 38 is pivoted at one end to the pivot of one of the stop arms 20, the other end being attached to a spring 40 urging the homing arm towards the main axis 6 of the hub.

As can be seen in FIG. 1, when the hub is at one of its three rest positions the arm contacts two of the three rollers 36. When the hub is being turned in a clockwise direction the homing arm 38 is pivoted outwardly by the right hand roller 36 against the bias of the spring 40 until the axis of the roller 36 is moved through 60°. From then onwards the bias of the homing arm spring tends to move the roller 36 and hence the hub in a clockwise direction as and until the next adjacent pair of rollers contacts the arm in the next rest position spaced 120° from the first rest position.

In the arrangement illustrated in FIG. 3 the operative or stop end of each (or the) stop arm 20 is provided with a roller 42, the arrangement being such that in its stop or second position the periphery of the roller 42 contacts the stop surface of the relevant tooth 14 about 1/16th'' inwardly from the edge of the tooth and is prevented from further inward movement due to the side of the arm contacting the side of an adjacent tooth. If then a user is pressing on a hub arm 4 at the moment he inserts the money to operate the solenoid 23, all the solenoid has to do is to withdraw the stop arm 20 for about 1/16th'' which movement is assisted by the roller 42, and thereafter further pressure by the user, will aid the withdrawal of the stop arm. This arrangement overcomes the problem which might arise with the arrangement illustrated in FIG. 1 where friction generated between the end 22 of the stop arm 20 and the stop surface of a tooth 14, due to a user pressing on an arm 4 of the hub, might be sufficient to prevent the solenoid 23 from withdrawing the arm 20 clear of the periphery of the disc 8.

In the modified version of turnstile mechanism as illustrated in FIG. 4 the teeth 14 are "straight-cut" teeth and the pair of stop arms 20 are pivoted between their ends to respective solenoids 23 acting to move the other ends of the stop arms as can clearly be seen in the drawing. The solenoids 23 are again controlled by the micro-switches 30 and 34 as explained with reference to the embodiment shown in FIG. 1.

The basic differences between the embodiments of FIGS. 1 and 4 is in the construction of the homing devices. In the FIG. 4 embodiment a three lobed cam member generally illustrated at 43 is attached to the main shaft 6 so as to rotate with the hub and discs 8 and 16. The three lobes are arranged in a roughly triangular shape and a roller 44 on a homing arm 46 which is biased by means (not shown) towards the axes of the cam 43 engages in the valley between two adjacent lobes in a rest position of the hub as shown in FIG. 4.

A damping arm 48 connected to a conventional damper unit 50 is formed with a roller 52 on its outer end the roller also engaging the periphery of the member 43. Thus on a rotational movement of 120° from the position shown in FIG. 4 the homing arm 46 is firstly moved outwardly by the cam lobe 51 against its spring bias while the damper arm 48 runs freely down the other side of the lobe 51. As the roller 44 moves past the top point 54 of the lobe 51, the bias of the homing arm 46 then helps to turn the cam member 43 and hence the hub in the clockwise direction until the roller 44 is engaged in the next valley 56 between the lobes 51 and 58. During this second 60° movement the roller 52 of the damper arm 48 is moved outwardly by the side of the adjacent lobe 58. This anti-clockwise movement of the damping arm 48 is resisted by the damping unit 50 which thus acts progressively to slow down the motion of the hub until the next home or rest position is reached.

If the solenoids are reversed so that they act to hold the stop arm(s) against the bias, in the stop or second position the solenoids being de-energised by an operator or an acceptance of a coin and energised by the respective micro-switch 30 then the arrangement is such that in the event of a power failure both stop arms will move to the free or first position and the turnstile will be free to rotate in one or both directions.

It will also be appreciated that the hub can be locked against movement in one or both directions by means of a mechanical lock which can be locally operated as required.

We claim:

1. A turnstile mechanism of the type having a hub adapted to be driven by a person using said turnstile mechanism, said hub being fixed in place on a rotatable shaft, said turnstile mechanism comprising a stop plate fixed in place on said rotatable shaft, said stop plate defining a number of stop surfaces thereon, a stop member positioned to engage the stop surfaces of said stop plate, said stop member being movable between a first position clear of the path of the stop surfaces and a second position lying in the path of the stop surfaces, a control device connected to said stop member, said control device being operable to hold said stop member against a bias in one of the first and second positions, and said control device being activated to change the position of said stop member from the first position to the second position after said hub has been rotated through a predetermined angle, and a cam plate fixed in place on said rotatable shaft, said cam plate defining at least one cam surface thereon, said cam surface being adapted to activate said control means in response to rotation of said hub through the predetermined angle.

2. A turnstile mechanism as set forth in claim 1, said control device including a solenoid connected to said stop member, and a switch connected with said solenoid for controlling movement of said stop member, said switch being positioned for operation by said cam surface.

3. A turnstile mechanism as set forth in claim 1, said control device including a solenoid connected with said stop member, said solenoid restraining said stop member in the first position clear of the path of the stop surfaces when said solenoid is energized.

4. A turnstile mechanism as set forth in claim 1, said stop member including two stop arms positioned to engage the stop surfaces of said stop plate, when in the second position one stop arm preventing rotation of said hub in one direction but allowing movement of said hub in the other direction, and when in the second position the other stop arm preventing rotation of said hub in said other direction but allowing rotation of said hub in said one direction.

5. A turnstile mechanism as set forth in claim 1, said stop member including a pivoted arm, and said stop surfaces being defined by teeth on the periphery of said stop plate, said stop arm being movable between a first position clear of said teeth and a second position engaging said teeth, and said stop arm being located relative to said teeth such that when said hub is in the second position it cooperates with said teeth to act as a pawl and ratchet device during rotation of said hub in one direction and to abut a tooth to stop rotation of said hub in the other direction of rotation.

6. A turnstile mechanism as set forth in claim 2 including a roller connected to said arm, said roller being selectively engageable with said stop surface to prevent rotation of said hub.

7. A turnstile mechanism as set forth in claim 1 including a homing device to bias said hub into a home position after said hub has passed through a portion of its predetermined angular movement.

8. A turnstile mechanism as set forth in claim 7 including a dampening device associated with said homing device, said dampening device providing a dampening effect on rotation of said hub as said hub approaches the home position.

9. A turnstile mechanism as set forth in claim 7, said homing device including a plurality of rollers rotatably mounted to said rotatable shaft, and a biased homing arm adapted to engage an adjacent two of said rollers in the home position, rotation of said hub from the home position causing said homing arm to move initially against its bias.

10. A turnstile mechanism as set forth in claim 7, said homing device including a cam member mounted to said hub for rotation therewith, said cam member defining a plurality of lobes with a valley between adjacent lobes defining the home position, and a biased homing arm adapted to cooperate with the periphery of said cam member, movement of said homing arm against its bias resulting from movement of said hub in either direction when the free end of said homing arm is initially engaged in one such valley.

11. A turnstile mechanism as set forth in claim 10 including a dampening device also adapted to cooperate with the periphery of said cam member and acting in opposition to said homing arm, said dampening device moving out from a valley to constitute a dampening effect during rotational movement towards the home position of said hub.

* * * * *